US005711288A

United States Patent [19]

Sparks

[11] Patent Number: 5,711,288

[45] Date of Patent: Jan. 27, 1998

[54] COOKING RANGE MOUNTED SPICE RACK

[75] Inventor: Walton E. Sparks, Dublin, Ohio

[73] Assignee: White Consolidated Industries, Inc., Cleveland, Ohio

[21] Appl. No.: 552,382

[22] Filed: Nov. 3, 1995

[51] Int. Cl.[6] ..... F24C 15/10

[52] U.S. Cl. ..... 126/37 R; 126/39 B; 126/276; 126/211

[58] Field of Search ..... 126/37 R, 276, 126/211, 268, 265, 25 R, 41 R

[56] References Cited

U.S. PATENT DOCUMENTS

| | | | |
|---|---|---|---|
| 1,633,089 | 6/1927 | Gercich | 126/39 B |
| 2,333,199 | 11/1943 | Ring | 126/37 R |
| 5,163,358 | 11/1992 | Hanagan et al. | 126/41 R |

*Primary Examiner*—Larry Jones
*Attorney, Agent, or Firm*—Pearne, Gordon, McCoy & Granger LLP

[57] ABSTRACT

A spice rack for a cooking range including a one piece shelf defining an elongated channel for receipt of spice containers. The spice rack includes a front panel and a rear panel, the rear panel having barrier members extending therefrom generally toward the front panel which separate the elongated channel into a series of smaller spaces for segregation of spice containers. The rear panel has a flange member extending therefrom which cooperates with the rear panel to define a channel for receipt of a mounting bracket. The mounting bracket is secured to a rear wall of the cooking range and vertically supports the spice rack and spaces the spice rack from heat producing portions of the cooking range. The spice rack also includes lateral flanges that serve as stops to limit lateral movement of the spice rack relative to the mounting bracket.

20 Claims, 4 Drawing Sheets

18
60a
44c
70
76
78
74
82
72
76a
58a
50
44a
44b
44
14
54a
70a
54b
56
32
48b
52
48a
48
64
60
40
46c
46a
46
46b
30

Fig.5
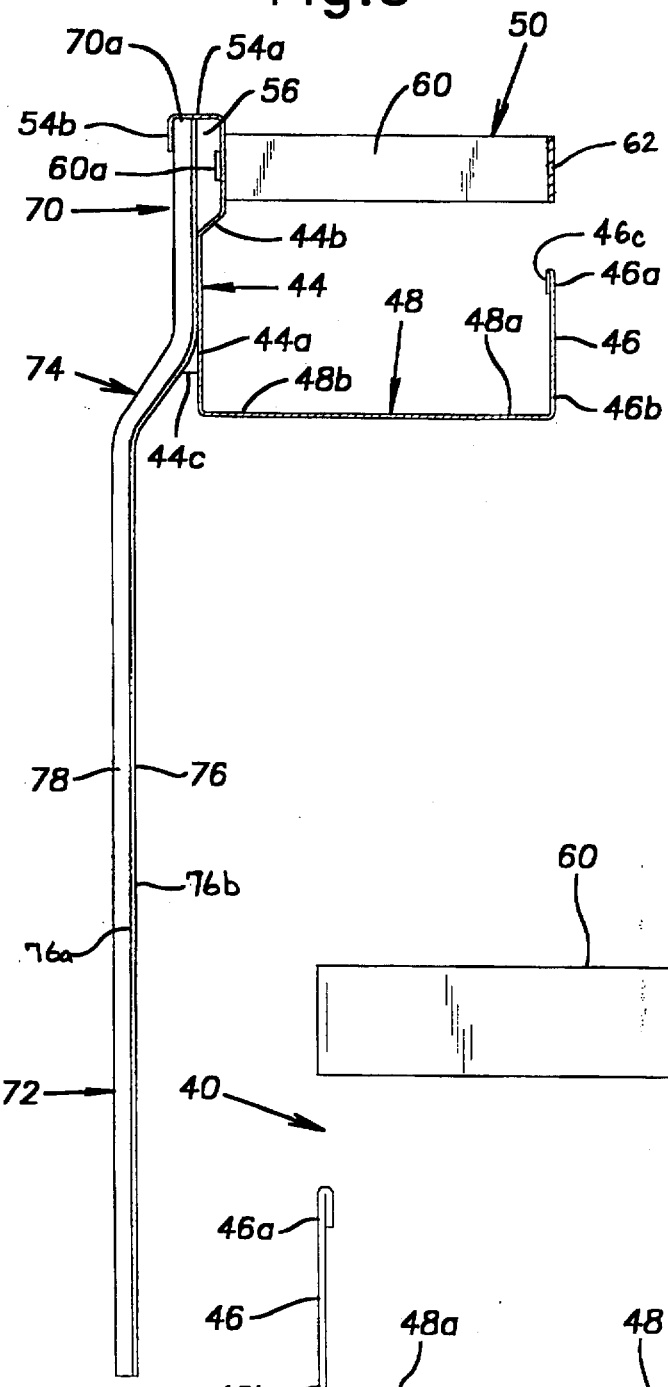
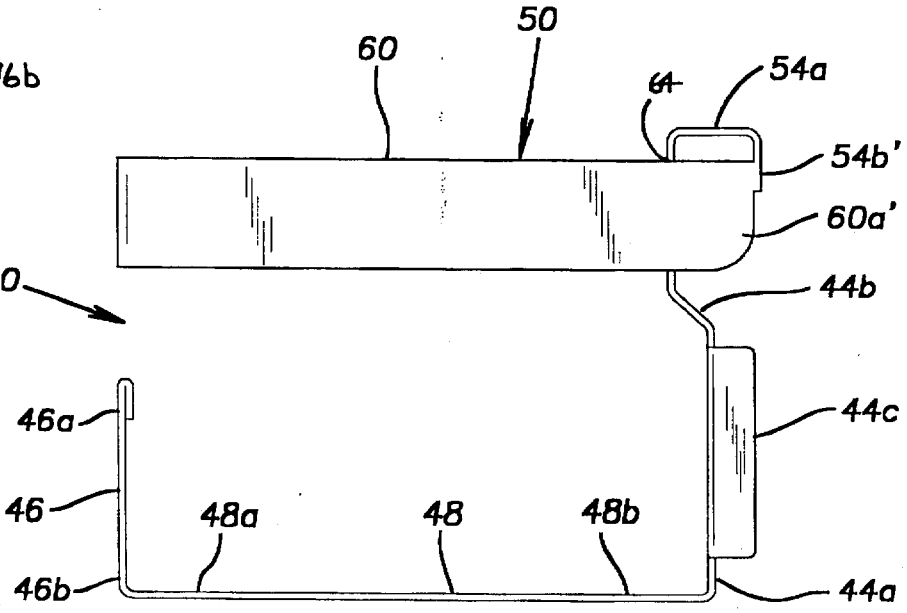
Fig.6

COOKING RANGE MOUNTED SPICE RACK

BACKGROUND OF THE INVENTION

1. Field of the Invention

The present invention generally relates to shelving and, more particularly, to spice racks or shelves mounted to a splash guard of a cooking range.

2. Description of Related Art

Several different designs of range-mounted shelves are known in the art. Typically, such shelves extend over the cook top portion of the range and are intended to function as food warmers. U.S. Design Pat. Nos. 47,463; 170,009; and 175,295 are exemplary of this type of range-mounted shelf. Food-warmer shelves of this type are not well suited for storage of spice containers due to the fact that repeated heating of the spice containers tends to degrade the quality of the spices therein. Moreover, heated spice containers may be difficult or impossible for a cook to handle without wearing protective gloves.

Several types of shelves specifically designed to hold spice containers are also known in the art. See, for example, U.S. Design Pat. Nos. 255,187; 291,755; and 332,724, and U.S. Pat. Nos. 3,851,937; 4,714,305; and 3,127,721. None of the shelves or spice racks shown in these patents is, however, mounted to a cooking range. Rather, the spice racks shown in each of these references is a separate piece of furniture, typically wall-mounted.

While wall-mounted spice racks avoid the heating problems associated with the prior art food warmer shelves, the spices stored therein are disassociated with the range. As such, the cook may inadvertently forget to add spices to the food being cooked.

Moreover, due to conventional kitchen cabinet placement, there is often little space on the wall directly above the range to which one of the aforementioned spice racks may be mounted. If permanently mounted to the wall above the range, cleaning of the spice rack, necessitated by grease and/or food splattering, is problematic.

Therefore, there exists a need in the art for a spice rack which eliminates or minimizes the problems found in the prior art.

SUMMARY OF THE INVENTION

The present invention is directed toward a spice rack which may be mounted to a cooking range at a location which is convenient for access and inspection, while being remote or isolated from the heat-producing portions of the range cook top to prevent or minimize heating and thermal degradation of the spices. The present invention is also directed to such a spice rack which is easily removable for cleaning, and which is formed of an easily cleaned and stain-resistant material.

In accordance with the present invention, the spice rack includes a bottom panel, a front panel, and a rear panel which cooperate to define an elongated channel for receipt of spice containers. A barrier member is provided which extends from the rear panel toward the front panel in a cantilever fashion. The barrier member is vertically spaced from the front panel and functionally divides the elongated channel into a plurality of shorter channels to permit segregation of spice containers.

In further accordance with the present invention, the rear panel of the spice rack includes an upper portion from which a flange member extends. The flange member cooperates with the rear panel to define a receptacle for a mounting bracket. More specifically, the mounting bracket includes an upper end which fits within the receptacle, and a lower end mechanically affixed to a rear wall of the cooking range cabinet.

The spice rack according to the present invention is supported by the mounting bracket and overlies a cooking range splash guard. The spice rack is frictionally held in place, and may be easily removed and replaced without the use of tools. The so-positioned spice rack is vertically and laterally spaced from heat producing portions of the cook top, and is not substantially heated by such portions. The spice rack is also slightly vertically spaced from the splash guard, which prevents conductive heating of the spice rack via the splash guard.

BRIEF DESCRIPTION OF THE DRAWINGS

The present invention will hereafter be described with reference to the drawings, wherein:

FIG. 5 is a side elevational view, in cross section, of the spice rack and mounting bracket as seen along line 5—5 of FIG. 4; and FIG. 6 is a side elevational view of a second embodiment of the spice rack according to the present invention.

DETAILED DESCRIPTION OF THE PREFERRED EMBODIMENTS

Figure 1:
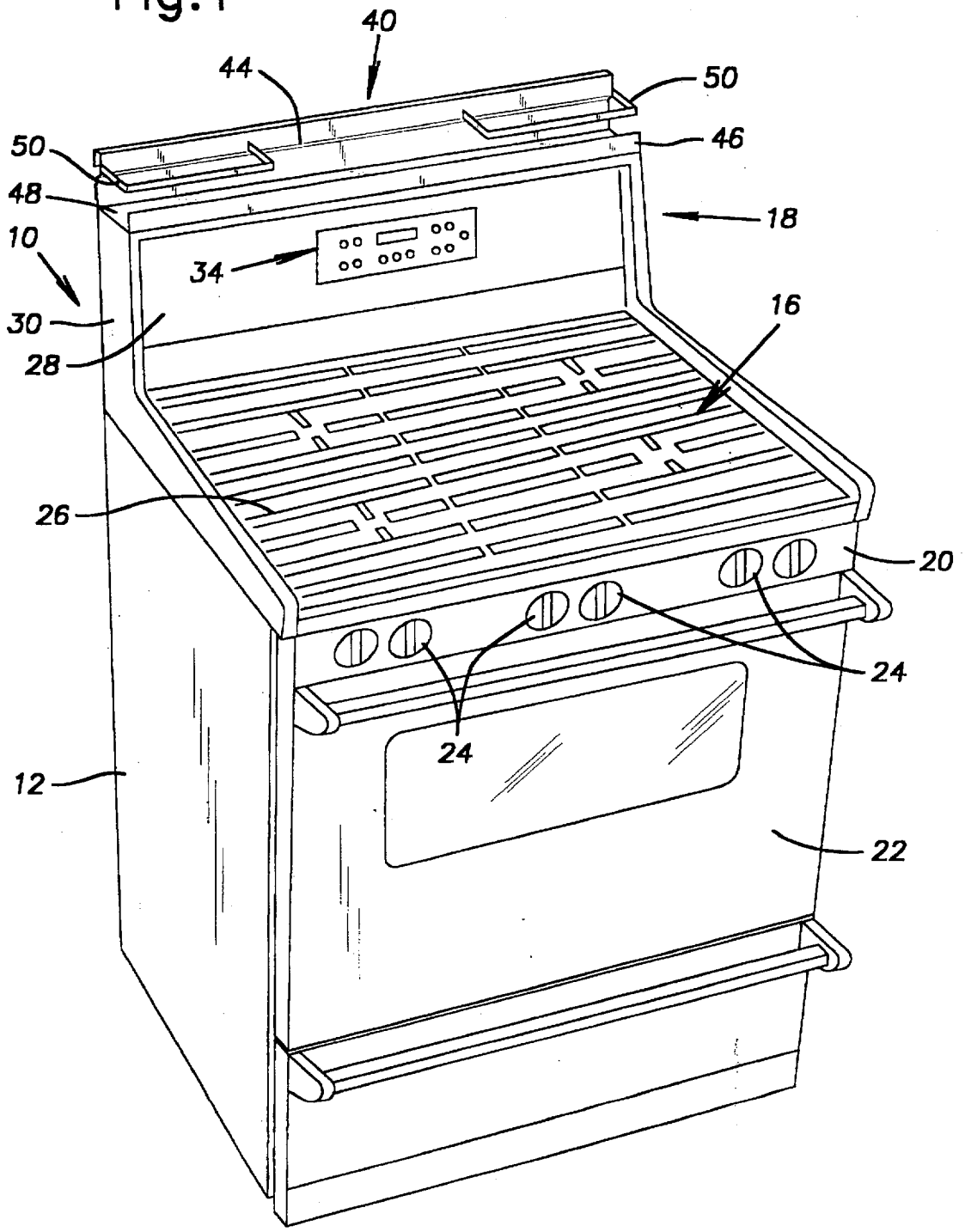
FIG. 1 is a perspective view of a range and spice rack according to the present invention.

With reference to FIGS. 1–5, a cooking range 10 is shown to include a pair of lateral side walls 12 (one shown), a rear wall 14, a top wall or cook top 16 mounted between the side walls 12, a splash guard 18 extending upwardly from a rear of the cook top 16, and a front wall 20 having an access opening formed therein which is covered by an oven door 22. The oven door 22 is mounted to pivot about its lower edge to permit access to an oven cavity therebehind. A plurality of control knobs 24 are provided on the front wall intermediate the cook top 16 and the oven door 22, and allow the user to control operation of cook top and oven heating elements.

In the case of a gas range 10, the cook top heating elements normally consist of four gas burners, two large and two small. Grates 26 overlie the heating elements and serve to support pots or pans thereabove. The rear wall 14 extends upwardly above the cook top 16 and covers a back of the splash guard 18.

The splash guard 18 is generally rectangular, and includes a front wall 28, a pair of end walls 30, and a generally planar top wall 32. A clock or various other controls or indicators 34 may be provided on the front wall 28 of the splash guard.

A spice rack 40, which is secured to the cooking range by means of a pair of mounting brackets 42, includes a rear panel 44, a front panel 46, a bottom panel 48, and a pair of barrier members 50. The rear, front, and bottom panels 44, 46, 48 are preferably integrally formed or stamped from a single piece of stain and heat resistant material, such as stainless steel. The barrier members 50 are also preferably formed from a stain and heat-resistant material, and are secured to the spice rack rear panel 44, as will be described more fully hereafter.

Figures 2, 3:
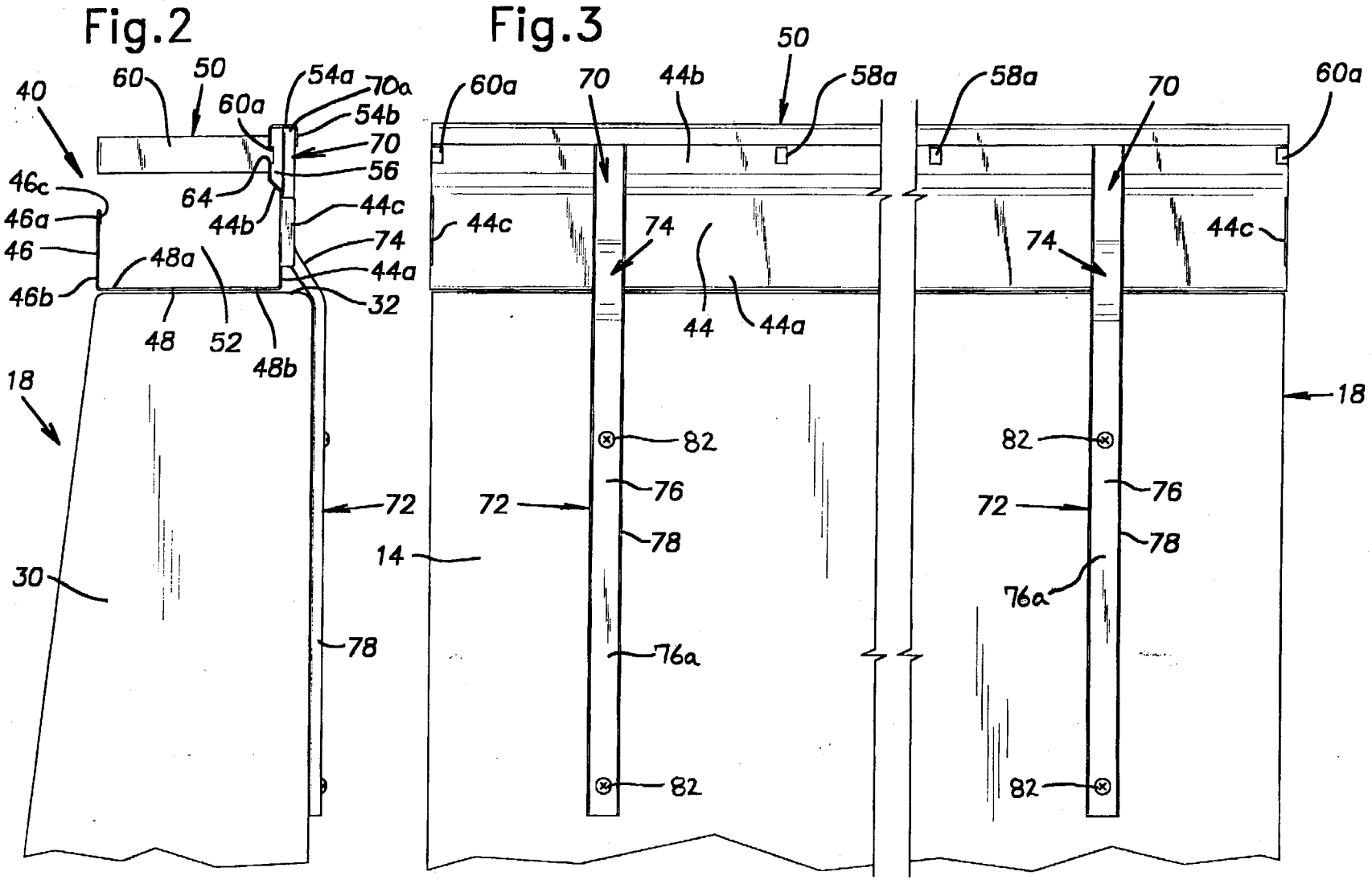
FIG. 2 is a side elevational view of the spice rack, a mounting bracket, and a top portion of the range shown in FIG. 1.
FIG. 3 is a rear elevational view of the range, spice rack, and mounting brackets shown in FIG. 2.
Figure 4:
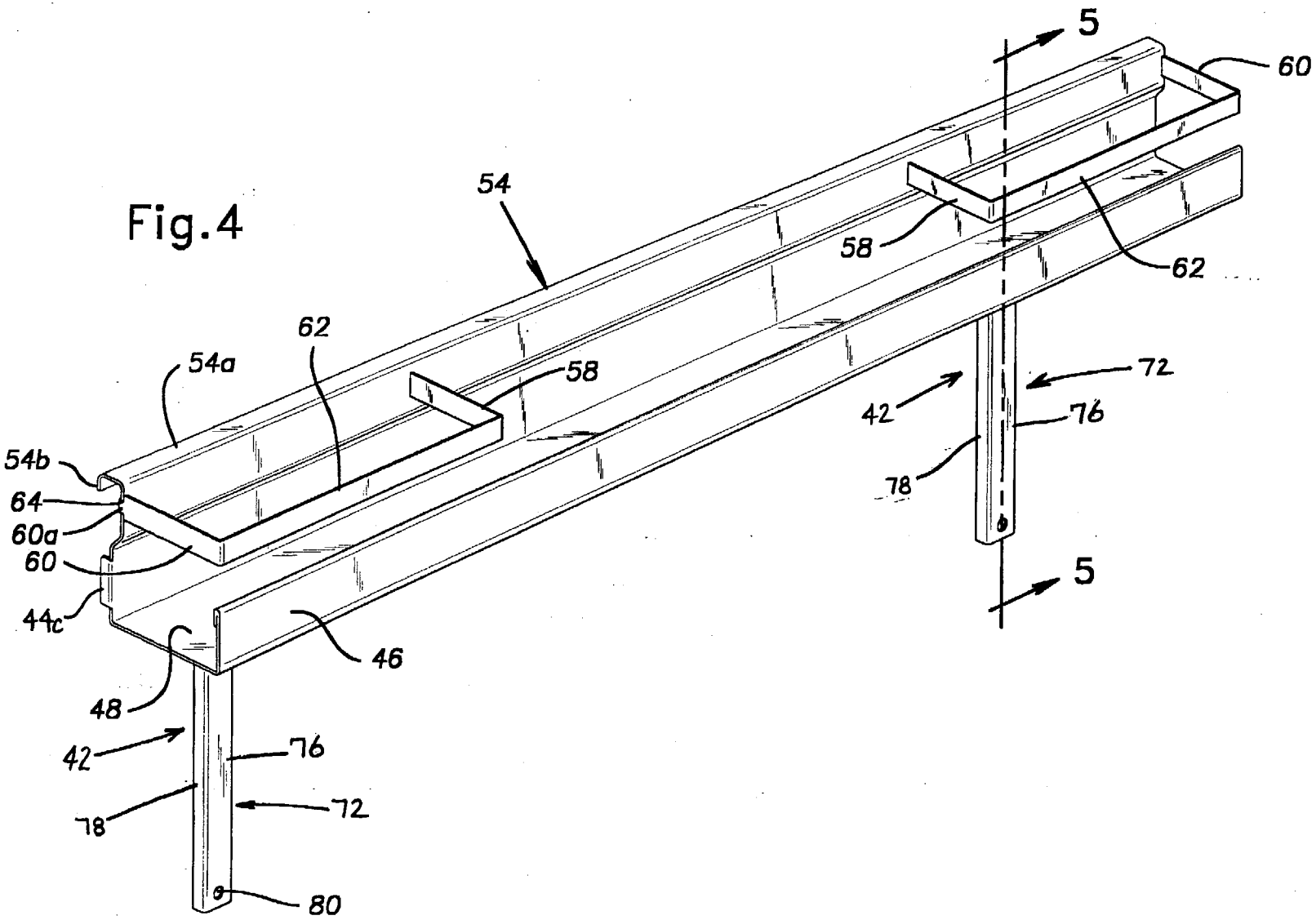
FIG. 4 is a front and side perspective view of the spice rack and mountings bracket according to the present invention.

With reference to FIGS. 2 and 5, the spice rack bottom panel 48 has front and rear edges 48*a*, 48*b*. The front panel 46 extends integrally upward from the front edge 48*a* and the rear panel 44 extends integrally upward from the rear edge 48*b*. The rear panel 44 extends upwardly, a greater distance from the bottom panel 48 than does the front panel 46, as illustrated. The front and rear panels 46, 44 are generally parallel to each other and perpendicular to the bottom panel 48. The bottom, front, and rear panels 48, 46, 44 thus cooperate to define an elongated, generally U-shaped channel 52 for receipt of spice containers or similar articles.

The front panel 46 has a lower portion 46*b* attached to the bottom panel 48, and an upper portion 46*a* remote from the bottom panel 48. The upper portion 46*a* is bent back or doubled over at an end thereof to define a double-thickness top edge 46*c*. Bending the upper portion 46*a* down toward the bottom panel 48 provides a smooth top edge 46*c* on the front panel 46.

The rear panel 44 includes a lower portion 44*a* attached to the bottom panel 48, and an upper portion 44*b* remote from the bottom panel 48. A lateral tab 44*c* extends rearwardly from each lateral edge of lower portion 44*a*.

The rear panel upper portion 44*b* is bent or inset toward the front panel 46 relative to the lower portion 44*a*, as illustrated. The upper portion 44*b* includes a flange member 54 having first and second portions 54*a*, 54*b*. The flange member first portion 54*a* extends outwardly from the rear panel 44 (generally parallel to the bottom panel 48) and away from the front panel 46. The flange member second portion 54*b* extends downwardly from the first portion 54*a* and is generally parallel to the front and rear panels 46, 44.

The flange member 54 and the upper portion 44*b* of the rear panel 44 cooperate to define an elongated generally inverted U-shaped channel 56 which receives the mounting bracket 42, as will be described more fully hereafter. The inverted U-shaped channel 56 has a longitudinal axis which is generally parallel to a longitudinal axis of the U-shaped channel 52 defined by the front, rear, and bottom panels 44, 46, 48. The lateral tabs 44*c* prevent the spice rack from sliding off the mounting brackets 42, as will be discussed more fully hereafter.

The barrier members 50 extend or project from the inset or upper portion 44*b* of the rear panel 44 toward the front panel 46 in a cantilever or unsupported fashion. Each barrier member 50 has first and second arms 58, 60, and a transverse leg 62. The first arm 58 includes, at a proximal end thereof, a tab 58*a* which extends through a slot formed in the inset or upper portion 44*b* of the rear panel 44. The tab 58*a* is bent over on the back side of the rear panel 44 and extends generally perpendicularly to the remainder of the first arm 58 (FIG. 3). The tab 58*a* may be attached to the rear panel 44 by a spot weld.

A proximal end of the second arm 60 includes a tab 60*a* which extends through a notch 64 formed in a lateral end of the rear panel upper portion 44*a*, and is bent over and mechanically attached, preferably by spot-welding, to the rear panel upper portion 44*a* (FIG. 2). The transverse leg 62 extends between distal ends of the first and second arms 58, 60, and generally overlies and is co-planar with the front panel 46, as illustrated.

The barrier members 50 effectively divide the U-shaped channel 52 into three separate compartments, and permit segregation of spice containers according to type or class. Lateral compartments surrounded by each barrier member 50 are preferably smaller in a length dimension than a center compartment intermediate the barrier members 50 delimited by the first arms 58 of the barrier members 50. The barrier members 50 limit the range of movement of spice containers along the length of the U-shaped channel 52 and thus prevent spice containers from sliding or falling out of the channel 52, as may otherwise occur during movement of the spice rack 40, or during movement of the cooking range 10 for cleaning purposes.

The mounting brackets 42 are preferably formed from a stain and heat-resistant material, such as stainless steel, and include an upper section 70 upon which the spice rack 40 rests, a lower section 72 secured to the rear wall 44 of the cooking range 10, and an angled intermediate section 74 between the upper and lower sections 70, 72. The upper and lower sections 70, 72 are generally parallel to one another, but offset horizontally due to the angled intermediate section 74. Each of the sections 70, 72, 74 includes a central portion 76 from which a pair of lateral ears 78 are bent. The central portion 76 has a first surface 76*a* and a second surface 76*b*, the first surface 76*a* being bounded by the lateral ears 78.

The lower section 72 of the mounting brackets 42 includes a pair of holes 80 through which screws 82 may extend to fasten the lower section 72 to the rear wall 14 of the cooking range 10.

The upper section 70 of the mounting brackets 42 includes an end portion which is received within the inverted U-shaped channel 56. More specifically, the upper section 70 includes a terminal edge 70*a* which engages the first portion 54*a* of the flange member 54 extending from the rear panel 44 of the spice rack 40. The second surface 76*b* of the mounting bracket upper section 76 is spaced rearwardly from the rear panel upper portion 44*b* and engages the rear panel lower portion 44*a*. The lateral ears 78 provided by the mounting bracket upper section 70 engage the flange member second portion 54*b*.

The angled intermediate section 74 extends outwardly and downwardly away from the rear panel lower portion 44*b*, as illustrated. The angled section 74 serves to position the upper section 76, and the spice rack 40, slightly inwardly or forwardly of a plane defined by the range rear wall 14, as should be apparent from the drawings.

In use, the mounting brackets 42 are secured to the cooking range rear wall 14 and extend or project upwardly above the top wall 32 of the splash guard 18. Preferably, the mounting brackets 42 are secured at a location inboard of lateral edges of the rear wall 14. The spice rack 40 is placed on and secured to the mounting brackets 42 merely by lifting the spice rack 40 vertically above the mounting brackets and lowering the spice rack onto the upper section 76 of the mounting brackets such that the upper section 76 extends into, and is received by, the inverted U-shaped channel 56 defined by the rear panel 44 and the flange member 54, as described previously. Engagement of the terminal edge 70*a* with the first portion 54*a* limits downward motion of the spice rack.

As so mounted, the spice rack 40 is spaced slightly vertically above the top wall 32 of the splash guard which prevents conductive heating therethrough. The spice rack is also spaced vertically and laterally from the heat producing burner elements of the cook top 16, thereby limiting convective heating of the spice rack and the items stored therein. The spice rack 40 is prevented from sliding off the mounting brackets 42 by the lateral flanges 44*c*, which serve as stops to limit sliding movement of the spice rack.

The spice rack may be easily removed from the mounting brackets 42 by merely vertically lifting the spice rack to effectively withdraw the mounting bracket upper sections 76 from the inverted U-shaped channel 56 of the spice rack. The barrier elements 50 retain stored items within the U-shaped channel 52 during removal or replacement of the spice rack 40 on the mounting brackets 42, and prevent the stored items from sliding out of the U-shaped channel.

FIG. 6 shows a second embodiment of the spice rack having an alternative construction and wherein like reference numerals are used to indicate structure identical to that of the first embodiment shown and described hereinbefore. In the second embodiment, the second arms 60 of the barrier elements 50 have a terminal portion 60*a*' which extends beyond the rear panel 44 and is mechanically attached, preferably by welding, to a distal end 54*b*' of the second portion 54*b*. As such, the terminal portion 60*a*' lends rigidity to the second portion 54*b* and cooperates with the lateral flanges 44*c* to define stop members to limit lateral movement of the spice rack relative to the mounting brackets.

The foregoing description has been provided to illustrate the preferred embodiments currently contemplated by the inventors, and is not intended to limit the scope of the claims appended hereto to the invention specifically shown and described. Rather, it is contemplated that numerous additions, deletions, modifications, substitutions, and rearrangements of parts may be resorted to without departing from the scope and spirit of the present invention, as defined by the claims appended hereto. For example, although the spice rack has been shown and described herein as being used in conjunction with a gas range, it is considered apparent that the spice rack has equal utility with an electric range, or other household appliance. Moreover, it is contemplated that the mounting brackets 42 could be slidably and removably received within pockets formed on the rear wall 14 of the cooking range 10 to eliminate the fasteners 82 required in the preferred and illustrated embodiment to secure the brackets to the range.

What is claimed is:

1. A range, comprising:

a cabinet including a rear wall, a pair of lateral side walls, a cook top extending between said panels, and a splash guard extending upwardly from said cook top, said cook top having a front wall, a top wall including at least one heating element, and a pair of end walls;

a shelf for storage of cooking ingredient containers adapted to mount to said cabinet, said shelf comprising:

a bottom panel delimited by a front edge and a rear edge;

a front panel extending upwardly from said front edge;

a rear panel extending upwardly from said rear edge, wherein said bottom, front, and rear panels cooperate to define an elongated channel for receipt of ingredient containers, and said bottom panel overlies said splash guard such that containers received within said channel are isolated from said at least one heating element to minimize heating thereof.

2. A range according to claim 1, wherein said front, bottom, and rear panels are formed integrally with one another.

3. A range according to claim 1, further comprising means for restraining containers placed within said elongated channel to limit movement of said containers in a lengthwise direction of said elongated channel.

4. A range according to claim 3, wherein said restraining means comprises a barrier member which extends outwardly from said rear panel generally toward said front panel, said barrier member extending transverse to said lengthwise direction.

5. A range according to claim 4, wherein said barrier member comprises a pair of parallel arms and a transverse leg, each of said arms having a proximal end mechanically attached to said rear panel and a distal end attached to said leg.

6. A range, comprising:

a cabinet including a rear wall, a pair of lateral side walls, a cook top extending between said panels, and a splash guard extending upwardly from said cook top, said cook top having a front wall, a top wall including at least one heating element, and a pair of end walls;

a shelf for storage of cooking ingredient containers adapted to mount to said cabinet, said shelf comprising:

a bottom panel delimited by a front edge and a rear edge;

a front panel extending upwardly from said front edge;

a rear panel extending upwardly from said rear edge, said bottom, front, and rear panels cooperating to define an elongated channel for receipt of ingredient containers, and said bottom panel overlies said splash guard such that containers received within said channel are isolated from said at least one heating element to minimize heating thereof; and a bracket which extends between said cabinet rear wall and the rear panel of the shelf, said bracket being operable to secure the shelf to the cabinet.

7. A range according to claim 6, wherein said bracket has a lower section mechanically attached to said rear wall and an upper section upon which the shelf rests, said shelf being lifted away from said upper section for removal of said shelf from said cabinet.

8. A range according to claim 6, further comprising a stop for limiting lateral movement of said shelf relative to said bracket.

9. A range, comprising:

a cabinet including a rear wall, a pair of lateral side walls, a cook top extending between said panels, and a splash guard extending upwardly from said cook top, said cook top having a front wall, a top wall including at least one heating element, and a pair of end walls;

a shelf for storage of cooking ingredient containers adapted to mount to said cabinet, said shelf comprising:

a bottom panel delimited by a front edge and a rear edge;

a front panel extending upwardly from said front edge;

a rear panel extending upwardly from said rear edge, said bottom, front, and rear panels cooperating to define an elongated channel for receipt of ingredient containers, and said bottom panel overlies said splash guard such that containers received within said channel are isolated from said at least one heating element to minimize heating thereof, said rear panel includes a lower portion attached to said bottom panel and an upper portion remote from said bottom panel and wherein a flange member extends from said upper portion, said flange member comprising a first portion extending rearwardly from said upper portion and a second portion extending downwardly from said first portion.

10. A range according to claim 9, wherein said first and second portions cooperate with said rear panel to define a generally inverted U-shaped channel.

11. A range according to claim 10, further comprising a bracket having a lower end secured to said cabinet rear wall and an upper end received within said inverted U-shaped channel.

12. A shelf for a cooking range, said shelf being adapted for mounting to the range at a location spaced from heat generating components of said range and being operable to hold containers, said shelf comprising:

a bottom panel delimited by a front edge and a rear edge;

a front panel extending upwardly from said front edge;

a rear panel extending upwardly from said rear edge;

wherein said bottom, front, and rear panels cooperate to define an elongated channel, and wherein containers may be placed upon said bottom panel and received within said channel and between said front and rear panels.

13. A shelf according to claim 12, further comprising means for restraining the containers received within the elongated channel to limit movement of said containers in a lengthwise direction of said elongated channel.

14. A shelf according to claim 13, wherein said restraining means comprises a barrier member which extends outwardly from said rear panel and generally toward said front panel, said barrier member extending transverse to said lengthwise direction.

15. A shelf according to claim 14, wherein said barrier member comprises a pair of parallel arms between which extends a leg, each of said arms having a proximal end mechanically attached to said rear panel and a distal end attached to said leg.

16. A shelf for a cooking range, said shelf being adapted for mounting to the range at a location spaced from heat generating components of said range and being operable to hold containers, said shelf comprising:

a bottom panel delimited by a front edge and a rear edge;

a front panel extending upwardly from said front edge;

a rear panel extending upwardly from said rear edge, said bottom, front, and rear panels cooperating to define an elongated channel, containers may be placed upon said bottom panel and received within said channel and between said front and rear panels; and a bracket operable to secure said shelf to the cooking range.

17. A shelf according to claim 16, wherein said rear panel includes a lower portion attached to said bottom panel and an upper portion remote from said bottom panel, a flange member comprising a first portion and a second portion extends from said upper portion, said first portion extends outwardly from said upper portion and said second portion extends downwardly from said first portion, said flange member cooperating with said rear panel to define an inverted U-shaped channel for receipt of said bracket.

18. A shelf according to claim 16, further comprising a stop for limiting lateral movement of said shelf relative to said bracket.

19. A shelf for a cooking range, said shelf being adapted for mounting to the range at a location spaced from heat generating components of said range and being operable to hold containers, said shelf comprising:

a bottom panel delimited by a front edge and a rear edge;

a front panel extending upwardly from said front edge;

a rear panel extending upwardly from said rear edge, said bottom, front, and rear panels cooperating to define an elongated channel, containers may be placed upon said bottom panel and received within said channel and between said front and rear panels; and a bracket for securing the shelf to the range, said rear panel including an upper portion remote from said bottom panel from which a flange member extends, said flange member cooperating with said rear panel to define a receptacle which receives said bracket.

20. A shelf according to claim 19, wherein said flange member includes a first portion extending outwardly from said rear panel upper portion and a second portion extending downwardly from said first portion, said first and second portions cooperating with said rear panel to define a generally inverted U-shaped channel which receives the bracket.

* * * * *